US008920603B2

(12) United States Patent
Björklund et al.

(10) Patent No.: US 8,920,603 B2
(45) Date of Patent: Dec. 30, 2014

(54) BLEACHING OF PULP

(75) Inventors: Magnus Björklund, Östersund (SE); Thomas Christopher Greschik, Göteborg (SE); Håkan Fägersten, Kode (SE)

(73) Assignee: Akzo Nobel N.V., Arnhem (NL)

( * ) Notice: Subject to any disclaimer, the term of this patent is extended or adjusted under 35 U.S.C. 154(b) by 542 days.

(21) Appl. No.: 11/870,016

(22) Filed: Oct. 10, 2007

(65) Prior Publication Data

US 2008/0087394 A1 Apr. 17, 2008

Related U.S. Application Data

(60) Provisional application No. 60/851,090, filed on Oct. 11, 2006.

(51) Int. Cl.

| | |
|---|---|
| ***D21C 9/14*** | (2006.01) |
| ***D21C 9/16*** | (2006.01) |
| *D21C 3/02* | (2006.01) |

(52) U.S. Cl.
CPC . *D21C 9/142* (2013.01); *D21C 3/02* (2013.01)
USPC ..... 162/88; 162/67

(58) Field of Classification Search
USPC ..... 162/88, 67
See application file for complete search history.

(56) References Cited

U.S. PATENT DOCUMENTS

| | | | | |
|---|---|---|---|---|
| 3,501,374 | A | 3/1970 | Jack et al. | |
| 5,030,324 | A | 7/1991 | Green | |
| 5,268,075 | A | 12/1993 | Chang et al. | |
| 6,174,409 | B1 * | 1/2001 | Sundaram et al. | 162/49 |
| 6,736,934 | B1 * | 5/2004 | Henricson et al. | 162/19 |
| 6,776,876 | B1 | 8/2004 | Vuorinen et al. | |
| 2003/0155086 | A1 * | 8/2003 | Sjoblom et al. | 162/6 |
| 2004/0026051 | A1 * | 2/2004 | Stromberg | 162/65 |
| 2005/0115692 | A1 * | 6/2005 | Thompson et al. | 162/80 |
| 2006/0201642 | A1 | 9/2006 | Shin et al. | |

FOREIGN PATENT DOCUMENTS

| | | | |
|---|---|---|---|
| EP | 0 940 498 | A1 | 9/1999 |
| EP | 0940498 | A1 | 9/1999 |
| EP | 1 270 805 | A2 | 1/2003 |
| EP | 1270805 | A2 | 1/2003 |
| GB | 1062734 | | 3/1967 |
| WO | 9111554 | A1 | 8/1991 |

OTHER PUBLICATIONS

Allison et al., Hexenuronic acid in kraft pulps from radiata pine, 1999, Appita Journal, 52(6), 448-453.*
Chai et al., The Fate of Hexenuronic Acid Groups During Alkaline Pulping of Loblolly Pine, May 2001, Journal of Pulp and Paper Science.*
Ferreira et al., Influence of Process Parameters on Brightness Reversion—A multivariate Analysis Approach, 2003, 1st International Colloquium on Eucalyptus Pulp (ICEP).*
European Search Report for Application No. EP 06 12 2119 dated Mar. 29, 2007.
"The Bleaching of Pulp," Third Edition, Tappi Press, edited by Singh, R. P. (1979 2 title pages, pp. 378-379 and 388-391.
International Standard ISO 302, "Pulps—Determination of Kappa number," First edition (1981) 6 pages.
International Standard ISO 2470, "Paper, board and pulps—Measurement of diffuse blue reflectance factor (ISO brightness," Third edition (1999) 14 pages.
Jiang, Z-H et al., "Hexenuronic acid groups in pulping and bleaching," ABTCP 2002, Sao Paulo, 18 pages.
Seuss, H. U. et al., "How to Improve Brightness Stability of ECF bleached Softwood and Hardwood Kraft Pulp," APPITA Conference, Canberra (2004) pp. 1-12.
Seuss, H.U. et al., "ECF Bleaching of Hardwood Pulp: How much effect can be achieved in the E stage?," ABTCP 38 Congreso Anual, Sao Paulo (2005) 13 pages.
Granstrom, A. et al., "Variables affecting the thermal yellowing of TCF-bleached birch kraft pulps," Nordic Pulp and Paper Research Journal, vol. 16, No. 1, pp. 18-23.
The Ljungberg Textbook—Pulp Technology; Karlstads Universitet (2004) title page and pp. 18-21.
Notice of Opposition for application 07808867.1 dated Dec. 6, 2013.
Handbook of Pulp, 2 Volume Set, Herbert Sixta (Editor) Wiley-VCH Verlag GmbH & Co., pp. 734-777, Feb. 2006.
Newsletter No. 2, Wood and Pulping Chemistry Research Network, Royal Institute of Technology, 2013.

* cited by examiner

*Primary Examiner* — Anthony Calandra
(74) *Attorney, Agent, or Firm* — Norris McLaughlin & Marcus PA

(57) ABSTRACT

The present invention relates to a process of bleaching pulp derived from an alkaline pulping process having a hexenuronic acid content prior to the final bleaching stage from about 1 to about 80 mmol/kg dry pulp, said process comprising three chlorine dioxide stages D0, D1, and D2, wherein the chlorine dioxide charges based on the total chlorine dioxide charge in a) D0 is from about 40 to about 60%;
b) D1 is from about 30 to about 55%;
c) D2 is from about 4 to about 20%, and wherein the final chlorine dioxide stage D2 is performed at a pH from about 2 to about 4.5. The invention also relates to a bleached pulp obtainable by the process.

4 Claims, No Drawings

BLEACHING OF PULP

The present invention relates to a bleaching process which decreases the brightness reversion or yellowing of an ECF bleached pulp.

BACKGROUND OF THE INVENTION

In the art of bleaching, the target is to provide high and stable brightness levels. However, brightness reversion or yellowing of pulp occurs to varying extent during storage and transportation to the paper mill depending on e.g. temperature, humidity, wood species, cooking conditions and bleaching sequence. It is therefore important to perform the bleaching so that the brightness reversion becomes as low as possible.

In the paper "How to Improve Brightness Stability of ECF bleached Softwood and Hardwood Kraft Pulp", Suess, H. U. et al, 2004, APPITA Conference, Canberra, a standard elemental chlorine free (ECF) bleaching sequence is disclosed. The bleached pulp obtained from this sequence may, however, suffer from considerable brightness reversion. Also The Ljungberg Textbook, Pulp Technology, 2004 generally discloses ECF bleaching in which brightness reversion may suffer from considerable brightness reversion. It would thus be of interest to provide a process further improving the brightness stability. The present invention intends to provide such process, particularly for decreasing the brightness reversion of pulps derived from an alkaline pulping process with a certain content of hexenuronic acid prior to the final bleaching stage.

THE INVENTION

The present invention relates to a process of bleaching pulp derived from an alkaline pulping process having a hexenuronic acid content prior to the final bleaching stage from about 1 to about 80 mmol/kg dry pulp, said process comprising three chlorine dioxide stages D0, D1, and D2, wherein the chlorine dioxide charges based on the total chlorine dioxide charge in a) D0 is from about 40 to about 60%;
b) D1 is from about 30 to about 55%;
c) D2 is from about 4 to about 20%, and wherein the final chlorine dioxide stage D2 is performed at a pH from about 2 to about 4.5.

The pulp to be bleached may be derived from lignocellulose-containing material which may comprise e.g. wood logs, finely-divided raw materials, and woody materials, such as wood particles and non-wood such as fibres of annual or perennial plants. The woody raw material can be derived from hardwood or softwood species, such as birch, beech, aspen, alder, eucalyptus, maple, acacia, mixed tropical hardwood, pine, fir, hemlock, larch, spruce, and mixtures thereof. Non-wood plant raw material can be provided from e.g. straws of grain crops, reed canary grass, reeds, flax, hemp, kenaf, jute, ramie, sisal, abaca, coir, bamboo, bagasse or combinations thereof. However, also pulp derived from recycled pulp may be used, either separately or in mixtures with virgin pulps. The pulp can be a chemical pulp, produced using an alkaline pulping process, for example sulphate, soda processes or modifications thereof with optional additives such as anthraquinone, e.g. the soda anthraquinone (AQ) pulping process. The chemical pulp obtainable from lignocellulose-containing materials may be subjected to one or more oxygen treatment stages subsequent to the pulping process. The process can be applied to chemically digested pulps having an initial kappa number, i.e. a kappa number after digestion but before oxygen delignification, in the range from about 5 to about 40, for example from about 8 to about 30, or from about 8 to about 25 The referred kappa number is measured according to the ISO 302 Standard Method.

According to one embodiment, the content of hexenuronic acids in the bleached pulp prior to the final bleaching stage is from about 5 to about 80 or from about 5 to about 25, or from about 5 to about 15 mmol/kg dry pulp.

According to one embodiment, the pH of the first chlorine dioxide bleaching stage ranges from about 2 to about 4, for example from about 2.5 to about 3.5. According to one embodiment, the pH of the second chlorine dioxide bleaching stage ranges from about 2.5 to about 4.5, for example from about 3 to about 4. According to one embodiment, the pH of the final chlorine dioxide bleaching stage ranges from about 2 to about 4.4 or from about 2 to about 4.3, for example from about 2 to about 4 or from about 2 to about 3.5, such as from about 2 to about 3.4 or from about 2 to about 3.3 or from about 2.5 to about 3, or any other sub-range within the range from about 2.5 to about 4.5.

According to one embodiment, the temperature of the first chlorine dioxide bleaching stage ranges from about 40 to about 90, for example from about 50 to about 80 or from about 55 to about 70° C. According to one embodiment, the temperature of the second chlorine dioxide bleaching stage ranges from about 70 to about 90, for example from about 80 to about 90° C. According to one embodiment, the temperature of the final chlorine dioxide bleaching stage ranges from about 80 to about 100, for example from about 85 to about 100, or from about 87 to about 100° C.

According to one embodiment, the pulp consistency in the chlorine dioxide bleaching stages ranges from about 1 to about 40, for example from about 3 to about 30 or from about 5 to about 15 wt %.

According to one embodiment, the charge of chlorine dioxide charge based on the total chlorine dioxide charge in D0 is from about 45 to about 55, for example from about 45 to about 50, or from about 45 to about 48%. According to one embodiment, the charge of chlorine dioxide charge based on the total chlorine dioxide charge in D1 is from about 35 to about 50, for example from about 40 to about 50, or from about 45 to about 50%. According to one embodiment, the charge of chlorine dioxide charge based on the total chlorine dioxide charge in D2 is from about 5 to about 15, for example from about 5 to about 12, or from about 5 to about 10%.

According to one embodiment, the retention time of the first chlorine dioxide bleaching stage is from about 20 to about 60, for example from about 30 to about 50, or from about 35 to about 45 minutes. According to one embodiment, the retention time of the second chlorine dioxide bleaching stage is from about 60 to about 240, for example from about 60 to about 120, or from about 60 to about 90 minutes. According to one embodiment, the retention time in the final chlorine dioxide bleaching stage is from about 90 to about 360, for example from about 110 to about 240, or from about 110 to about 180 minutes. According to one embodiment, the bleaching process may comprise besides chlorine dioxide stages for example ozone, peracid, oxygen and/or peroxide-containing, as well as enzyme-containing bleaching stages either in addition to the sequence of three chlorine dioxide stages or substituting any of the initial chlorine dioxide stages. According to one embodiment, also washing and/or extraction stages, acidification and/or chelating agent stages may be present in the bleaching process preceeding, between and/or subsequent to any bleaching stages.

According to one embodiment, chlorine dioxide and chelating agent stages can be carried out without any make-up chemicals added, as both stages can be performed at similar pH ranges.

According to one embodiment, a chelating agent stage is carried out essentially in absence of chlorine dioxide, as essentially most of the chlorine dioxide is washed away by the washing stage.

According to one embodiment, if exceptionally an acid is added to the treatment with the chelating agent, an acid readily available in the pulp mill may be employed.

According to one embodiment, for example subsequent to treatment with a chelating agent, the pulp can be bleached with a peroxide-containing compound which can be an inorganic peroxide compound such as hydrogen peroxide or peroxomonosulphuric acid (cards acid) or an inorganic peroxide compound like aliphatic peracids and aromatic peracids and salts thereof. Suitable organic peroxides are peracetic acid and performic acid. For example, the peroxide-containing compound is hydrogen peroxide or a mixture of hydrogen peroxide and peracetic acid commonly referred to as equilibrium peracetic acid. When hydrogen peroxide is used the pH of the pulp suspension is suitably above 7, for example in the range from about 7 to about 13, from about 8 to about 12, or from about 9.5 to about 11.5. The temperature of the hydrogen peroxide bleaching may be from about 30 to about 130, for example from about 50 to about 100, or from about 50 to about 90° C. The length of the hydrogen peroxide treatment may be from about 3 to about 960, for example from about 10 to about 360, or from about 60 to about 240 minutes. Usually the amount of added hydrogen peroxide is from about 1 to about 60, for example from about 6 to about 50, or from about 13 to about 40 kg per tonne dry pulp. Other bleaching agents may be added to the hydrogen peroxide bleaching stage such as oxygen.

According to one embodiment, the bleaching process comprises an ECF (Elemental Chlorine Free) or a substantially ECF sequence, for example according to the following sequence: D0(OP)D1nD2, where D0, D1, and D2 indicate three chlorine dioxide (D) stages, OP indicates an oxygen-containing peroxide stage, and n indicates a neutral washing stage. According to one embodiment, the bleached pulp is subsequently treated as an aqueous suspension prior to papermaking by dewatering and drying said suspension, wherein the pH of the suspension to be treated ranges from about 6.5 to about 12. The bleached pulp may be further treated as set out in U.S. application Ser. No. 11/847,374.

According to one embodiment, the invention also relates to a bleached pulp obtainable by the process defined herein.

The invention being thus described, it will be obvious that the same may be varied in many ways. Such variations are not to be regarded as a departure from the gist and scope of the present invention, and all such modifications as would be obvious to one skilled in the art are intended to be included within the scope of the claims. The following examples will further illustrate how the described invention may be performed without limiting the scope of it.

All parts and percentages refer to part and percent by weight, if not otherwise stated.

EXAMPLES

The experiments were carried out employing an industrial oxygen-delignified eucalyptus pulp. The characteristics of the oxygen-delignified pulp is shown in table 1. The pulp could be characterized as a low bleaching chemical demand pulp with high content of hexenuronic acid (HexA). The pulp had an unbleached kappa number of 10.7 and required 1.5 kg/t $H_2O_2$ and 27 kg/t $ClO_2$ in the sequence D0(OP)D1nD2 to reach the brightness target 90.5% ISO.

TABLE 1

| Oxygen delignified eucalyptus pulp | | | |
|---|---|---|---|
| Kappa number | ISO Brightness (%) | Viscosity $dm^3/kg$ | Hexenuronic acid mmol/kg |
| 10.7 | 58.9 | 1030 | 71 |

The aim of the experiments was to improve a standard ECF sequence, D0(OP)D1nD2, in view of brightness reversion within the limitations of an existing mill. The same total dosage of chlorine dioxide was made in all experiments.

The conditions in the D1 and D2 stages and the distribution of chlorine dioxide were varied whereas the conditions in the D0 and (OP) stages were kept constant. The retention time and temperature in the D0 stage were 45 minutes and 60° C. The (OP) stage was performed at a pressure of 0.5 MPa, a retention time of 60 minutes, a temperature of 80° C. and a final pH between 11.6 and 11.9. The hydrogen peroxide ($H_2O_2$) dosage was 1.5 kg/t on oven dry pulp in all experiments. The pulp and chemicals were mixed at 10 wt % pulp consistency and distributed uniformly in polypropylene bags, the atmosphere of which was saturated with oxygen. The plastic bags were sealed and placed in autoclaves which were pressurized with oxygen. The chlorine dioxide dosages were given as active chlorine. The consistency was 10 wt % in all bleaching stages. All non-pressurised stages were carried out in sealed plastic polyethylene bags.

After each bleaching stage, the pulp was washed with distilled water. In the neutral wash stage (n) between the D1 and D2 stages, the pH was adjusted to between 7 and 10 with NaOH. The kappa number and ISO brightness were determined according to ISO 302 and ISO 2470 respectively. The hexenuronic acid was determined by acidic hydrolysis of the pulp in a formate buffer followed by UV analysis of the 2-furoic acid formed in the hydrolysate.

The accelerated heat-induced brightness reversion was evaluated as humid brightness reversion. The "humid brightness reversion" was evaluated by measuring the brightness loss after the sheet had been conditioned at 23° C. and 50% relative humidity, sealed in a polyethylene bag, kept at 70° C. for 64 h and finally removed from the bag and allowed to temperate at room temperature for at least 1 h. The brightness reversion was reported as the difference in ISO brightness units before and after reversion treatment.

Example 1

The results after bleaching the pulp according to the invention and the reference are set out in table 2. pH and chlorine dioxide distribution in the stages D0, D1, and D2 were varied as set out in table 2.

TABLE 2

Results of different modifications of the standard ECF sequence

| Bleaching Approach | D1-D2 pH | D1-D2 Temp. ° C. | D0/D1/D2 Distribution % of total charge | Brightness % ISO | Humid Brightness Reversion ISO units |
|---|---|---|---|---|---|
| Reference | 3.0-6.1 | 90-90 | 56/41/3 | 90.5 | 14.4 |
| Invention | 3.0-3.0 | 90-90 | 45/45/10 | 90.0 | 10.5 |

In table 2, the effect of the final pH in the D2 stage and the distribution of chlorine dioxide charge in stages D0, D1, and D2 is shown, as well as humid brightness reversion. The humid reversion was reduced from 14.4 in the reference to 10.5 units according to the invention, thus a considerable improvement.

The invention claimed is:

1. A process of bleaching pulp derived from an alkaline pulping process, said process comprising three chlorine dioxide stages D0, D1, and D2, wherein the chlorine dioxide charges based on the total chlorine dioxide charge in a) D0 is from 40 to 60%;

b) D1 is from 30 to 55%;

c) D2 is from 4 to 20%, wherein the pulp has a hexenuronic acid content after the D1 stage and prior to the final D2 bleaching stage from about 1 to about 80 mmol/kg dry pulp, wherein the final chlorine dioxide stage D2 is performed at a pH from 2 to 3.5, and wherein said process further comprises an oxygen-containing peroxide stage OP between the D0 and D1 stages.

2. The process according to claim 1, wherein said process further comprises a neutral washing stage n between the D1 and D2 stages, wherein the pH is adjusted to a value in the range of from 7 to 10 in said n stage.

3. The process according to claim 2, wherein the chlorine dioxide stage D0 is performed at a retention time of about 20 to about 60 minutes.

4. The process according to claim 3, wherein the temperature of the D0 stage ranges from 55 to 70° C. and the temperature of the final chlorine dioxide bleaching stage D2 ranges from 85 to 100° C.

* * * * *